US009482391B2

(12) United States Patent
Su

(10) Patent No.: US 9,482,391 B2
(45) Date of Patent: Nov. 1, 2016

(54) OMNIDIRECTIONAL LED BULB

(71) Applicant: Chin-Feng Su, Kaohsiung (TW)

(72) Inventor: Chin-Feng Su, Kaohsiung (TW)

( * ) Notice: Subject to any disclaimer, the term of this patent is extended or adjusted under 35 U.S.C. 154(b) by 140 days.

(21) Appl. No.: 14/571,313

(22) Filed: Dec. 16, 2014

(65) Prior Publication Data

US 2015/0098223 A1 Apr. 9, 2015

(30) Foreign Application Priority Data

Jan. 3, 2014 (TW) ..... 103200099 U

(51) Int. Cl.

| | |
|---|---|
| ***F21V 29/00*** | (2015.01) |
| ***F21K 99/00*** | (2016.01) |
| ***F21V 29/51*** | (2015.01) |
| ***F21V 29/76*** | (2015.01) |
| *F21V 3/00* | (2015.01) |

(52) U.S. Cl.

CPC ..... *F21K 9/135* (2013.01); *F21K 9/232* (2016.08); *F21V 29/51* (2015.01); *F21V 29/76* (2015.01); *F21V 3/00* (2013.01); *F21Y 2107/30* (2016.08); *F21Y 2115/10* (2016.08)

(58) Field of Classification Search

CPC ..... F21K 9/135; F21K 9/232; F21V 29/51; F21V 29/76; F21V 3/00; F21V 29/00; F21Y 111/005; F21Y 2115/10; F21Y 2107/30

See application file for complete search history.

(56) References Cited

U.S. PATENT DOCUMENTS

| | | | | |
|---|---|---|---|---|
| 8,272,766 | B2 * | 9/2012 | Phipps | F21V 29/004 362/218 |
| 8,596,821 | B2 * | 12/2013 | Brandes | F21K 9/135 362/249.01 |
| 8,723,205 | B2 * | 5/2014 | Ramer | H01L 33/50 165/104.19 |
| 9,068,701 | B2 * | 6/2015 | Progl | F21K 9/135 |
| 9,103,507 | B2 * | 8/2015 | Allen | F21K 9/135 |
| 9,217,542 | B2 * | 12/2015 | Pickard | F21K 9/135 |
| 9,234,655 | B2 * | 1/2016 | Progl | F21V 29/004 |
| 9,360,167 | B2 * | 6/2016 | Imai | H01L 33/60 |
| 2010/0309671 | A1 * | 12/2010 | Meyer, IV | F21K 9/00 362/373 |
| 2011/0285267 | A1 * | 11/2011 | Lu | F21K 9/00 313/46 |
| 2012/0268936 | A1 * | 10/2012 | Pickard | F21K 9/135 362/249.02 |
| 2013/0114253 | A1 * | 5/2013 | Segawa | F21K 9/135 362/235 |

* cited by examiner

*Primary Examiner* — Michael Zarroli

(57) ABSTRACT

An omnidirectional LED bulb has a base, a light-transmitting shell, a heat-dissipating pillar and an LED module. The light-transmitting shell is mounted on the base and has a lateral surface and a top surface. The heat-dissipating pillar is mounted on the base and has multiple mounting surfaces facing toward the lateral surface and the top surface of the light-transmitting shell. The LED module is mounted on the mounting surfaces of the heat-dissipating pillar. The LED module emits light through the lateral surface and the top surface of the light-transmitting shell to form an omnidirectional illumination.

1 Claim, 12 Drawing Sheets

OMNIDIRECTIONAL LED BULB

BACKGROUND OF THE INVENTION

1. Field of the Invention

The invention relates to an LED (light emitting diode) bulb, and more particularly to an omnidirectional LED bulb.

2. Brief Description of the Prior Art

A conventional LED bulb disclosed in the U.S. Pat. No. 8,567,990 includes mainly a substrate which is attached to one edge of a radiator. A cover is provided to shield the substrate. Heat-radiating fins may be provided on the other edge of the radiator and an air-cooling unit is provided inside the heat-radiating fins so as to achieve a free heat radiation. In the embodiments of U.S. Pat. No. 8,567,990, there is a case for storing a circuit part which is attached to the other edge of the radiator. The case has a cap to cover the same. With the airflow from the air-cooling unit, the heat-radiating fins become a part of the ventilation path to allow ventilation inside the radiator.

Another conventional LED bulb comprises a heat sink, an LED circuit board with LEDs, and a light-transmitting shell. An electrical connector is mounted on a rear terminal of the heat sink. The LED circuit board is mounted on a front surface of the heat sink. The shell is light-transmitting and mounted on the front surface of the heat sink to contain the LED circuit board. When the electrical connector is electrically connected to a socket, the LED circuit board receives a working voltage for activating the LEDs to emit light forward. However, the LEDs shall emit light forward only. The LEDs fail to emit light laterally or backward due to the heat sink mounted behind the LEDs to block the emitted light. As a result, the conventional LED bulb is not capable of emitting uniform and omnidirectional illumination.

SUMMARY OF THE INVENTION

An objective of the invention is to provide an omnidirectional LED bulb to overcome the shortcoming of the conventional LED bulb that fails to uniformly illuminate.

The omnidirectional LED bulb of the invention comprises a base, a light-transmitting shell, a heat-dissipating pillar, and an LED module. The base has a heat-dissipating connector and an electrical connector. The light-transmitting shell is mounted on the base and comprises a lateral surface and a top surface. A chamber is formed within the light-transmitting shell and the base. The heat-dissipating pillar is mounted on the heat-dissipating connector within the chamber and comprises multiple mounting surfaces facing toward the lateral surface and the top surface of the light-transmitting shell. The LED module is mounted on the mounting surfaces of the heat-dissipating pillar.

According to the invention and because of the LED module is mounted on the mounting surfaces of the heat-dissipating pillar which respectively facing toward the lateral surface and the top surface of the light-transmitting shell, the LEDs on the LED module emit light through the lateral surface and the top surface of the light-transmitting shell to form an omnidirectional illumination. Compared with the conventional LED bulb, the invention does not have a heat sink behind the LED module to block the emitted light from the LEDs. Therefore, the LED bulb of the invention achieves omnidirectional illumination.

In addition, the omnidirectional LED bulb according to the invention may further comprise a heat pipe and a heat sink. The heat pipe is attached to the heat-dissipating pillar, also to the heat sink. When the LED module is activated, heat produced by the LED module is transferred from the LED module to the heat pipe and the heat sink to result an enhanced heat dissipating efficiency. In addition, due to high heat dissipating efficiency, brightness of the light emitted from the LED module can be increased.

BRIEF DESCRIPTION OF THE DRAWINGS

Other objectives, advantages and features of the omnidirectional LED bulb according to the invention will become apparent as described in the preferred embodiments of the invention with reference to the accompanying drawings, wherein.

DETAILED DESCRIPTION OF THE PREFERRED EMBODIMENT

Figure 1:
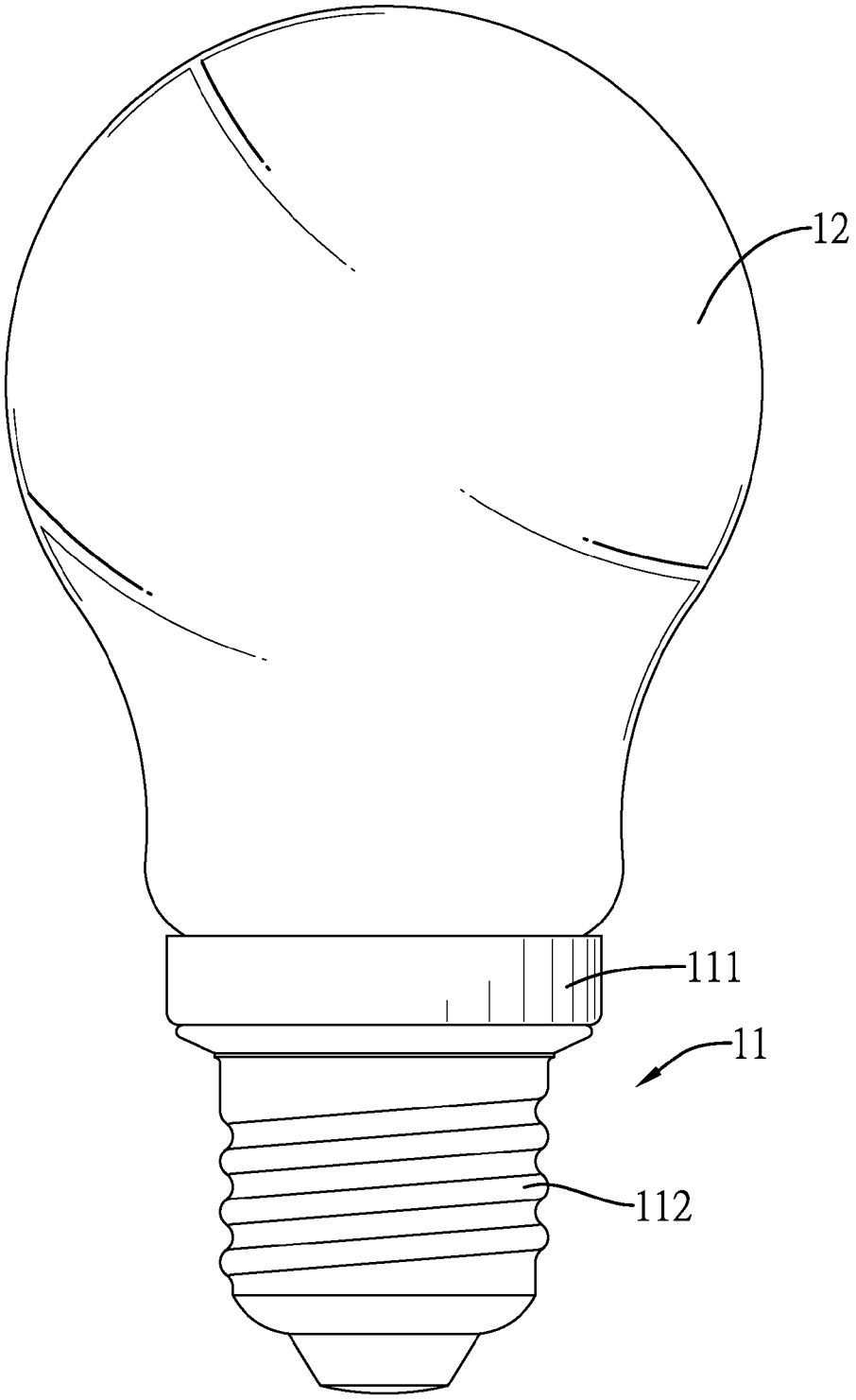
FIG. 1 is a schematic perspective view of a first embodiment of the omnidirectional LED bulb of the invention.
Figure 2:
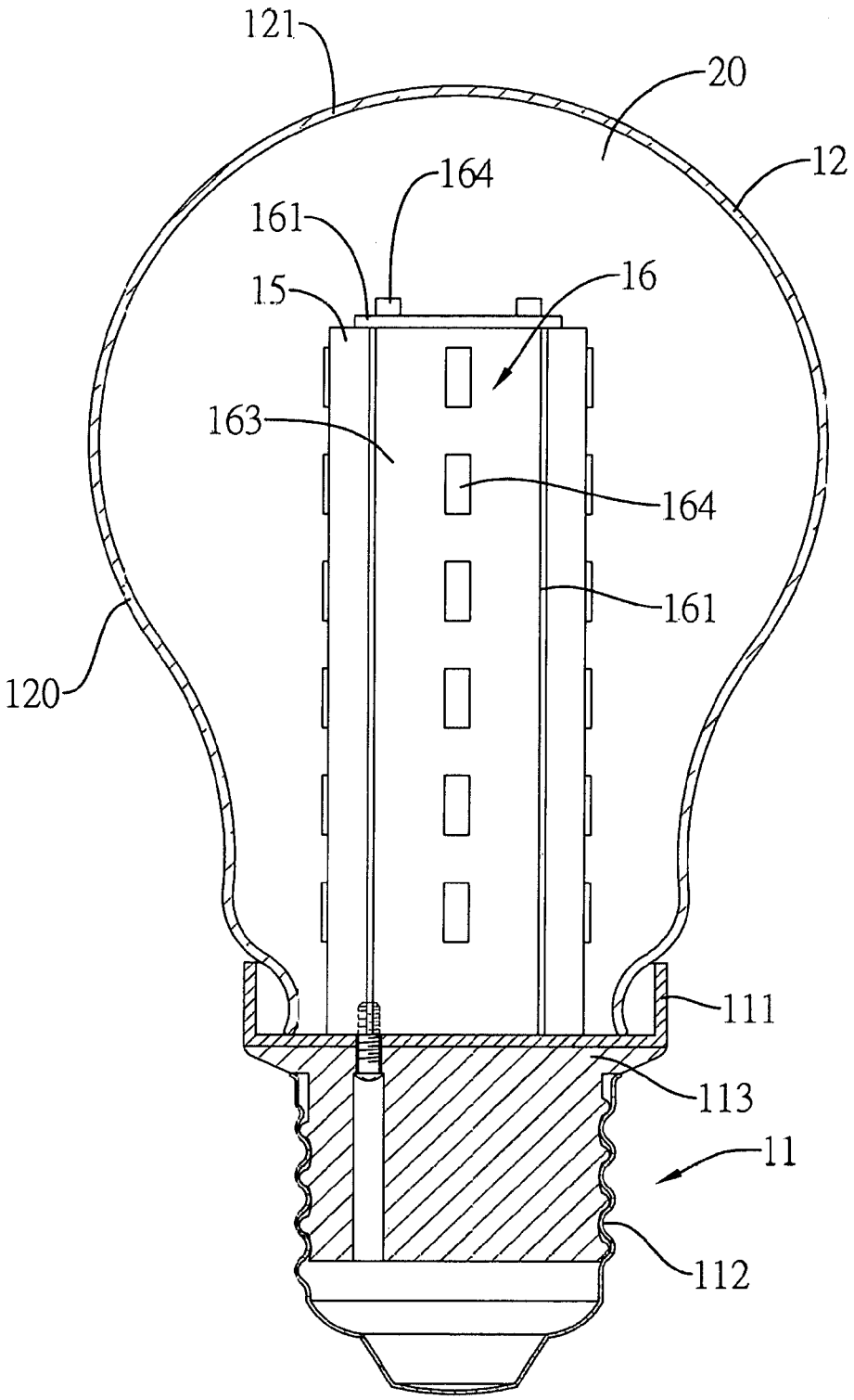
FIG. 2 is a cross-sectional view of the first embodiment of the omnidirectional LED bulb of the invention.
Figure 3:
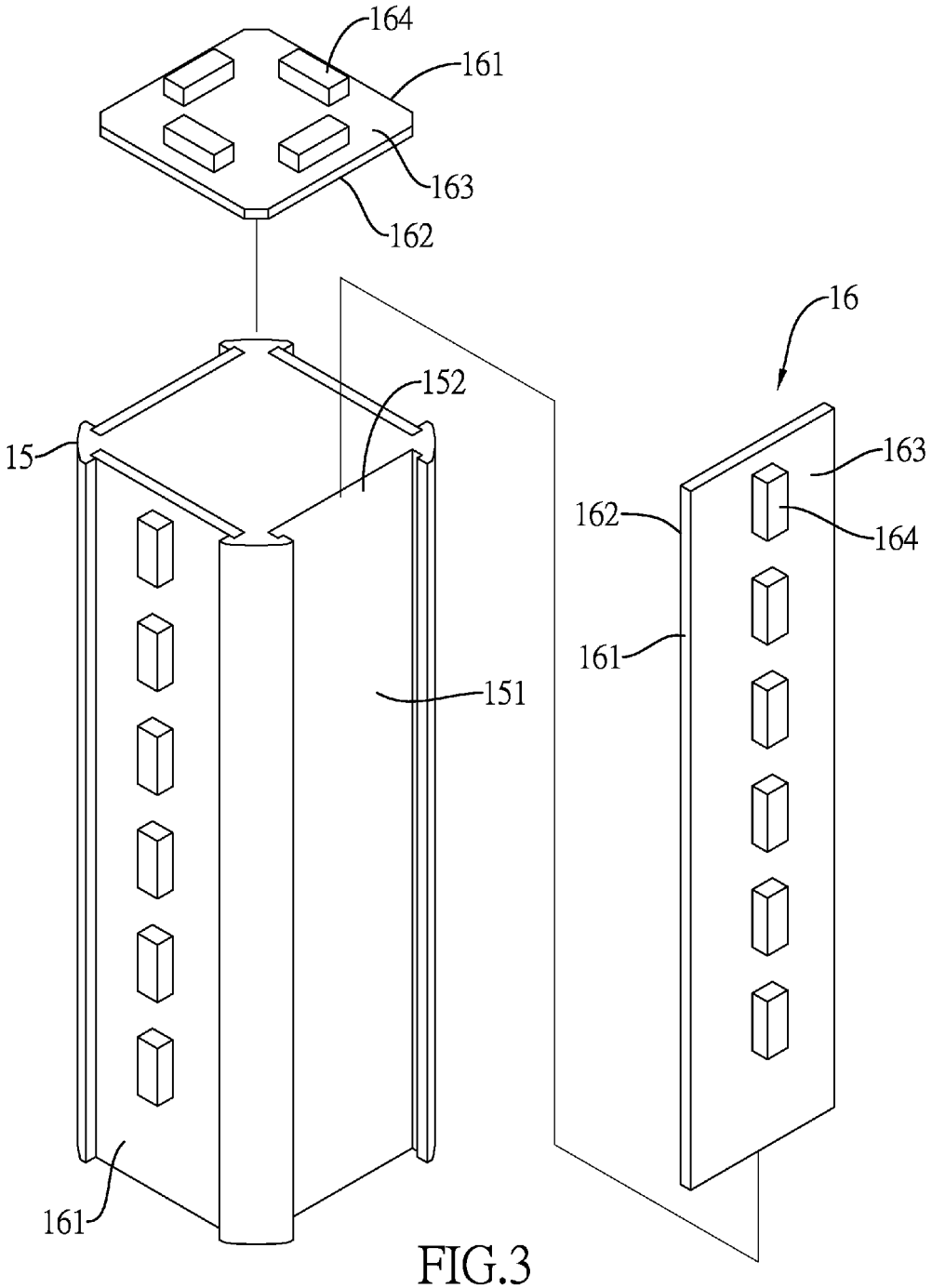
FIG. 3 is an exploded view of the heat-dissipating pillar and the LED module for the first embodiment of the omnidirectional LED bulb of invention.

With reference to FIGS. 1 to 3, a first embodiment of the omnidirectional LED (light emitting diode) bulb of the invention comprises a base 11, a light-transmitting shell 12, a heat-dissipating pillar 15 and an LED module 16.

With reference to FIG. 1 and FIG. 2, the base 11 comprises a heat-dissipating connector 111 and an electrical connector 112. In the first embodiment, the heat-dissipating connector 111 is formed on an insulating body 113. The electrical connector 112 is mounted on the insulating body 113 and comprises a positive electrode and a negative electrode for receiving a working voltage. The electrical connector 112 can be an E10 base, an E11 base, an E12 base, an E14 base, an E17 base, an E26 base, an E27 base, an E39 base, an E40 base, an EX39 base, a GU10 base, or a GU24 base. The heat-dissipating connector 111 can be made of aluminum, copper, plastic or ceramic materials.

With reference to FIG. 2, the light-transmitting shell 12 is securely mounted on the heat-dissipating connector 111 of the base 11 to cover the heat-dissipating pillar 15 and the LED module 16. The light-transmitting shell 12 has a lateral surface 120 and a top surface 121. A chamber 20 is formed within the light-transmitting shell 12 and the base 11 to contain the heat-dissipating pillar 15 and the LED module 16.

With reference to FIG. 2 and FIG. 3, the heat-dissipating pillar 15 has a top and a bottom end. The bottom end of the heat-dissipating pillar 15 is mounted on the heat-dissipating connecter 111. The heat-dissipating pillar 15 has a plurality of mounting surfaces 151. The mounting surfaces 151 face toward the lateral surface 120 and the top surface 121 of the light-transmitting shell 12. In this first embodiment, the heat-dissipating pillar 15 is a square pillar. The top end of the heat-dissipating pillar 15 is also defined as a mounting surface facing toward the top surface 121 of the light-transmitting shell 12. Each of the four lateral surfaces of the heat-dissipating pillar 15 has an engagement groove 152 respectively. The LED module 16 is installed by inserting into the engagement groove 152.

With reference to FIG. 2 and FIG. 3, the LED module 16 comprises five substrates 161. The substrates 161 are respectively mounted in the engagement grooves 152 of the heat-dissipating pillar 15. Furthermore, one of the substrates 161 is mounted on the mounting surface 151 on the top end of the heat-dissipating pillar 15. In the first embodiment, an LED driving circuit can be integrated in each substrate 161, and the LED driving circuit can be electrically connected to the electrical connector 112 via wires. Each substrate 161 has a rear surface 162 and a front surface 163. At least one LED device 164 is mounted on the front surface 163 of each substrate 161. The LED driving circuit is electrically connected to the at least one LED device 164 to activate the at least one LED device 164. When the substrate 161 is mounted in the engagement groove 152, the rear surface 162 of the substrate 161 is attached to the mounting surface 151 of the heat-dissipating pillar 15. The front surface 163 of each substrate 161 faces toward the lateral surface 120 of the light-transmitting shell 12. The front surface 163 of the substrate 161, which is mounted on the top end of the heat-dissipating pillar 15, faces toward the top surface 121 of the light-transmitting shell 12. The substrate 161 can be a flexible printed circuit board (FPC), a metal core printed circuit board (MCPCB) or FR-4 board.

With reference to FIGS. 4 to 7, a second embodiment of the omnidirectional LED bulb of the invention further comprises a heat pipe 13. The heat pipe 13 has two ends. A first end of the heat pipe 13 is mounted to the heat-dissipating connector 111 of the base 11. A second end of the heat pipe 13 is away from the heat-dissipating connector and protrudes from the base 11 to be exposed within the light-transmitting shell 12. Particularly referring to FIG. 5, the heat pipe 13 has an inner surface and a sealed space 131 enclosed by the inner surface. The sealed space 131 contains cooling liquid 132 that can be coolants or pure water. A metal powder layer can be disposed on the inner surface of the heat pipe 13. The metal powder layer has multiple pores, such that the cooling liquid 132 is adhered in the pores.

Figure 4:
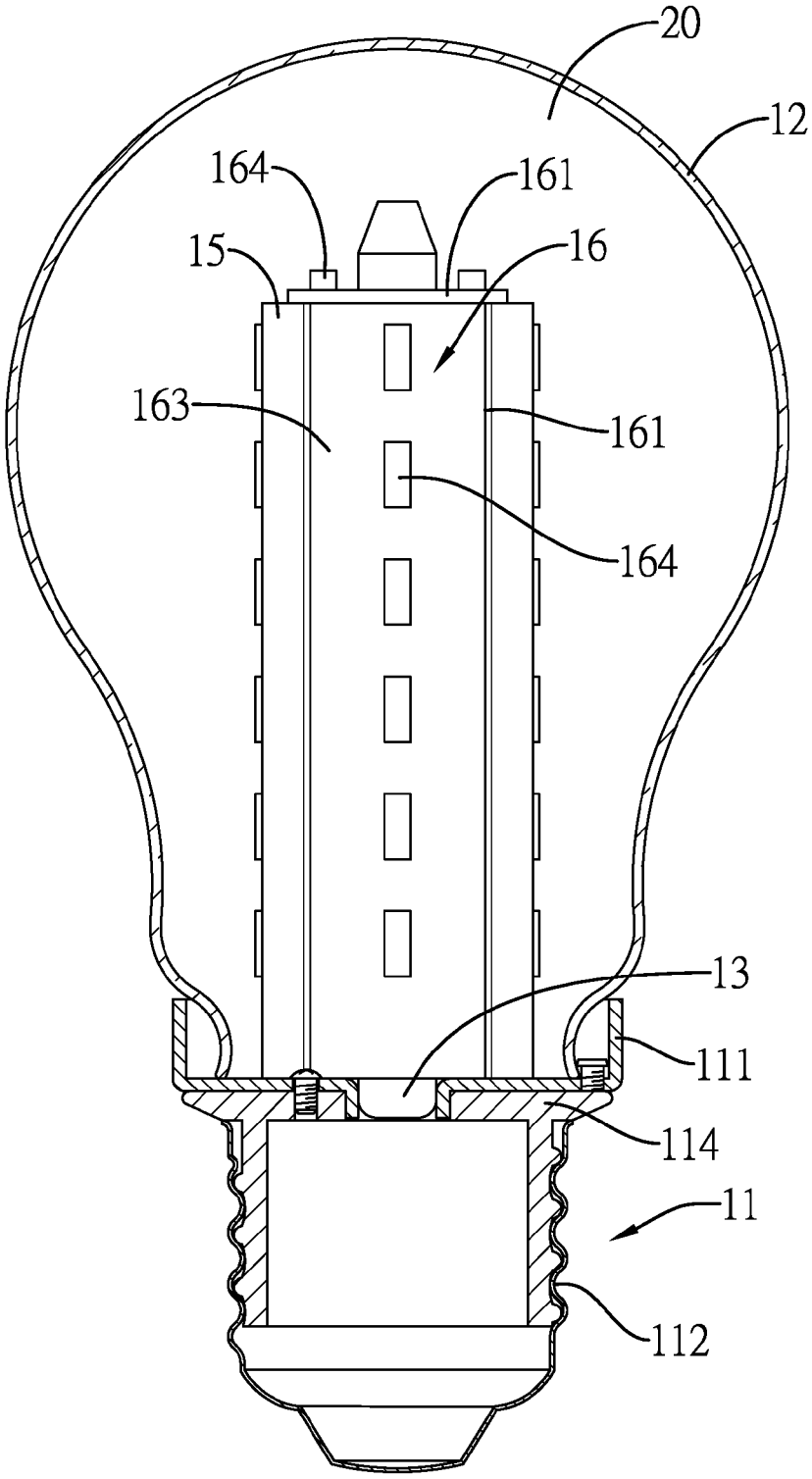
FIG. 4 is a cross-sectional view of a second embodiment of the omnidirectional LED bulb of the invention.
Figure 5:
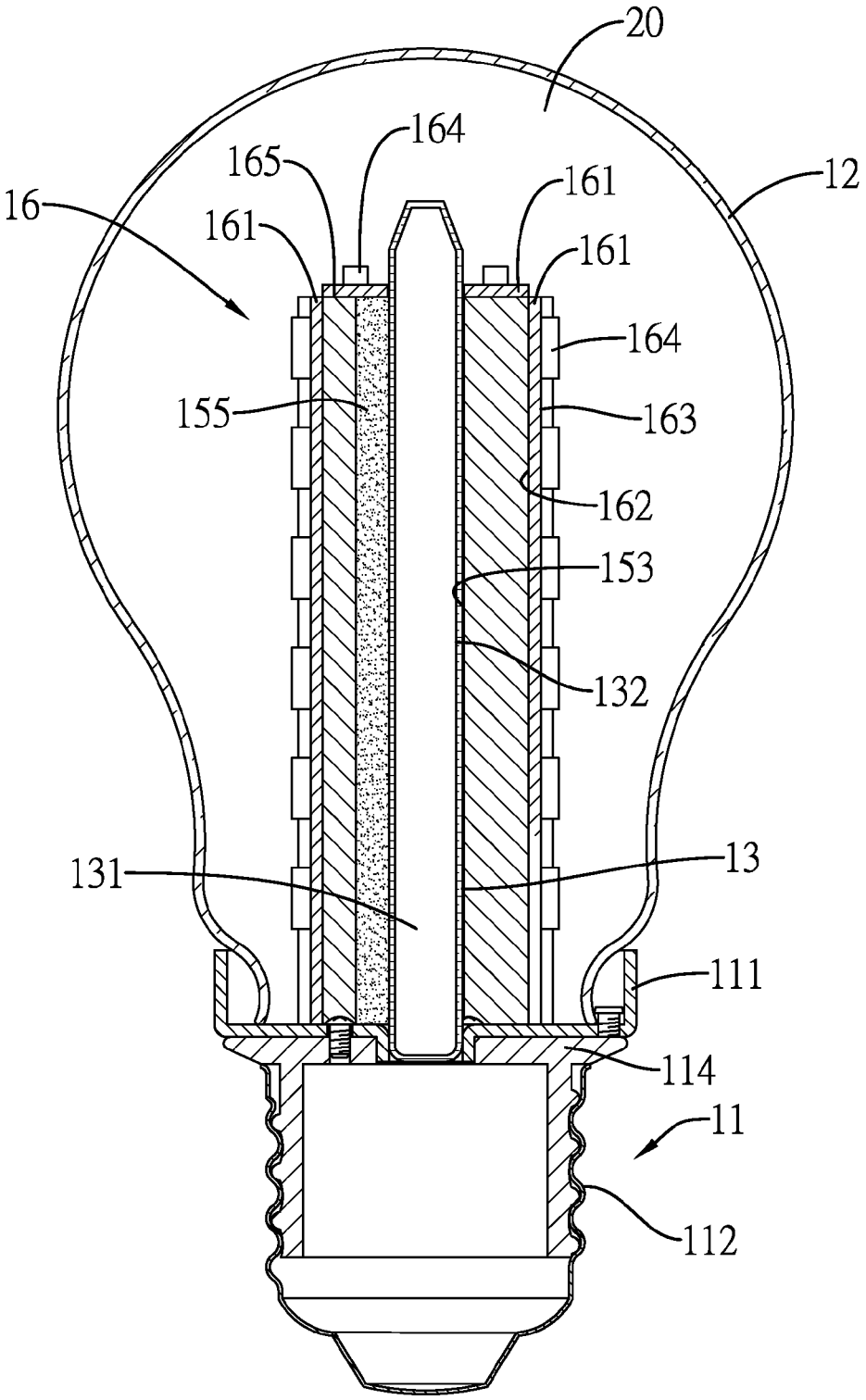
FIG. 5 is another cross-sectional view of the second embodiment of the omnidirectional LED bulb of the invention.
Figure 6:
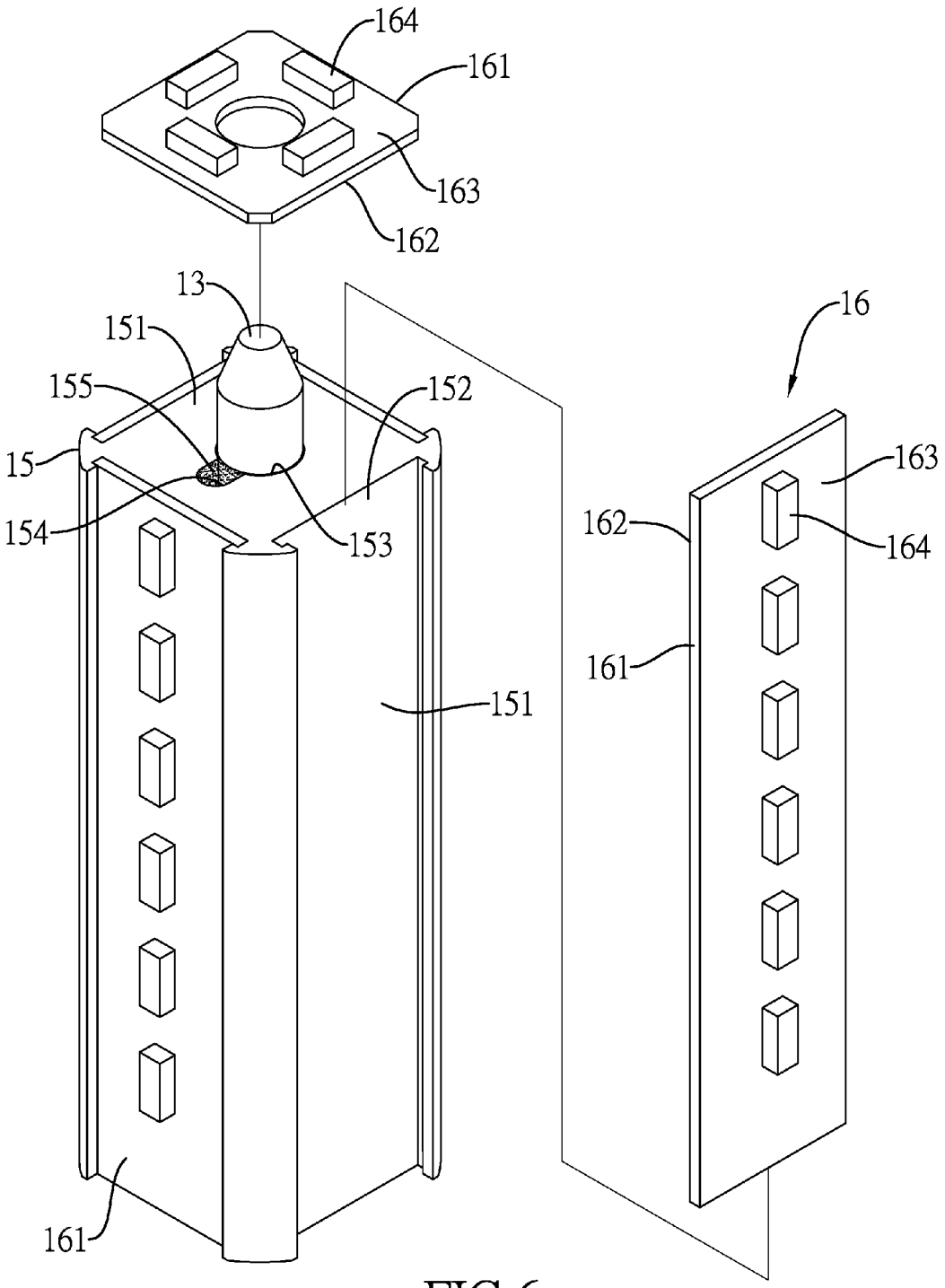
FIG. 6 is an exploded view of the heat-dissipating pillar and the LED module for the second embodiment of the omnidirectional LED bulk of the invention.
Figure 7:
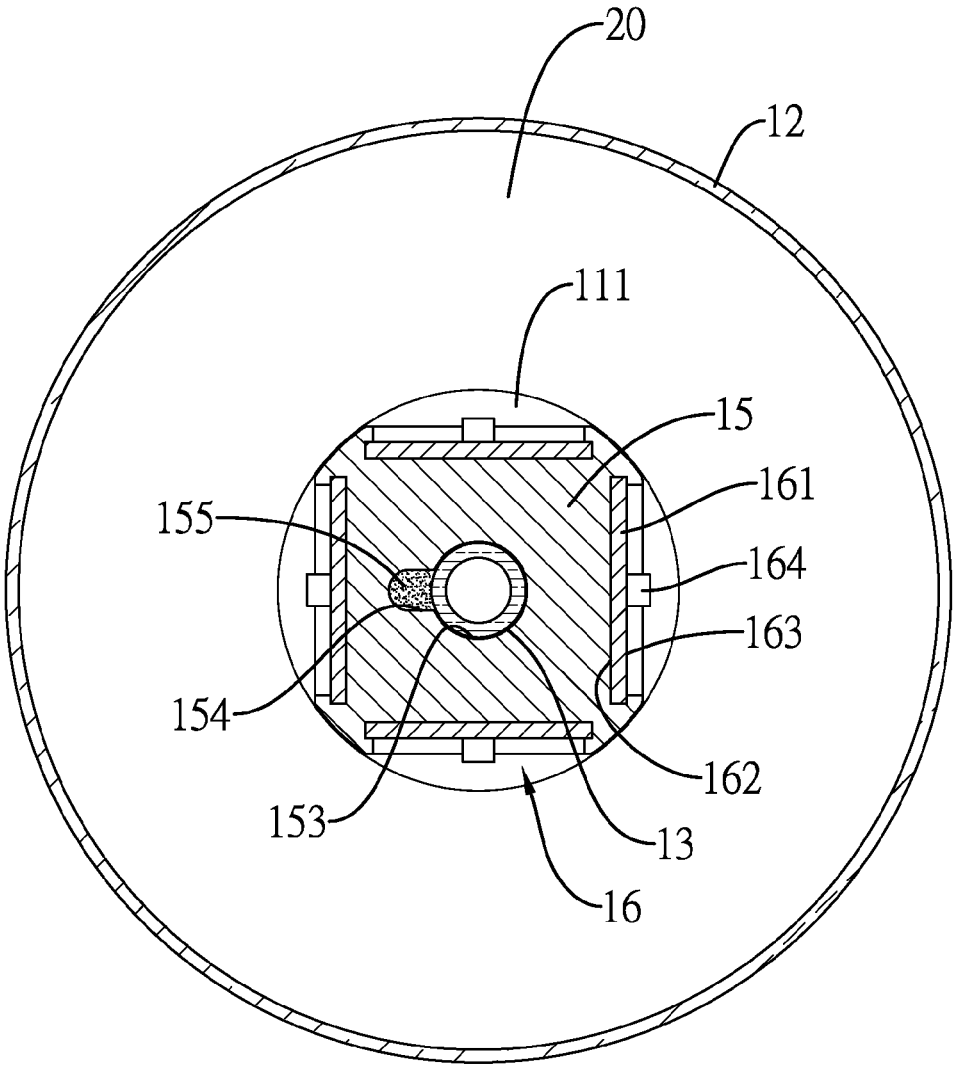
FIG. 7 is another horizontally cross-sectional view of the second embodiment of the omnidirectional LED bulb of the invention.

With reference to FIG. 4 to FIG. 6, the heat-dissipating pillar 15 has an axial hole 153 and a gel groove 154 communicating with the axial hole 153. The heat pipe 13 is inserted into the axial hole 153. The gel groove 154 is filled with gel 155. The heat pipe 13 is thus securely adhered to the heat-dissipating pillar 15 by the gel 155.

In a second embodiment, the heat-dissipating connector 111 is mounted on an insulating body 114, wherein the insulating body 114 and the heat-dissipating connector 111 are two individual components. The electrical connector 112 is mounted on the insulating body 114. As the same structure described in the first embodiment, the LED driving circuit is integrated in each substrate 161.

Figure 8:
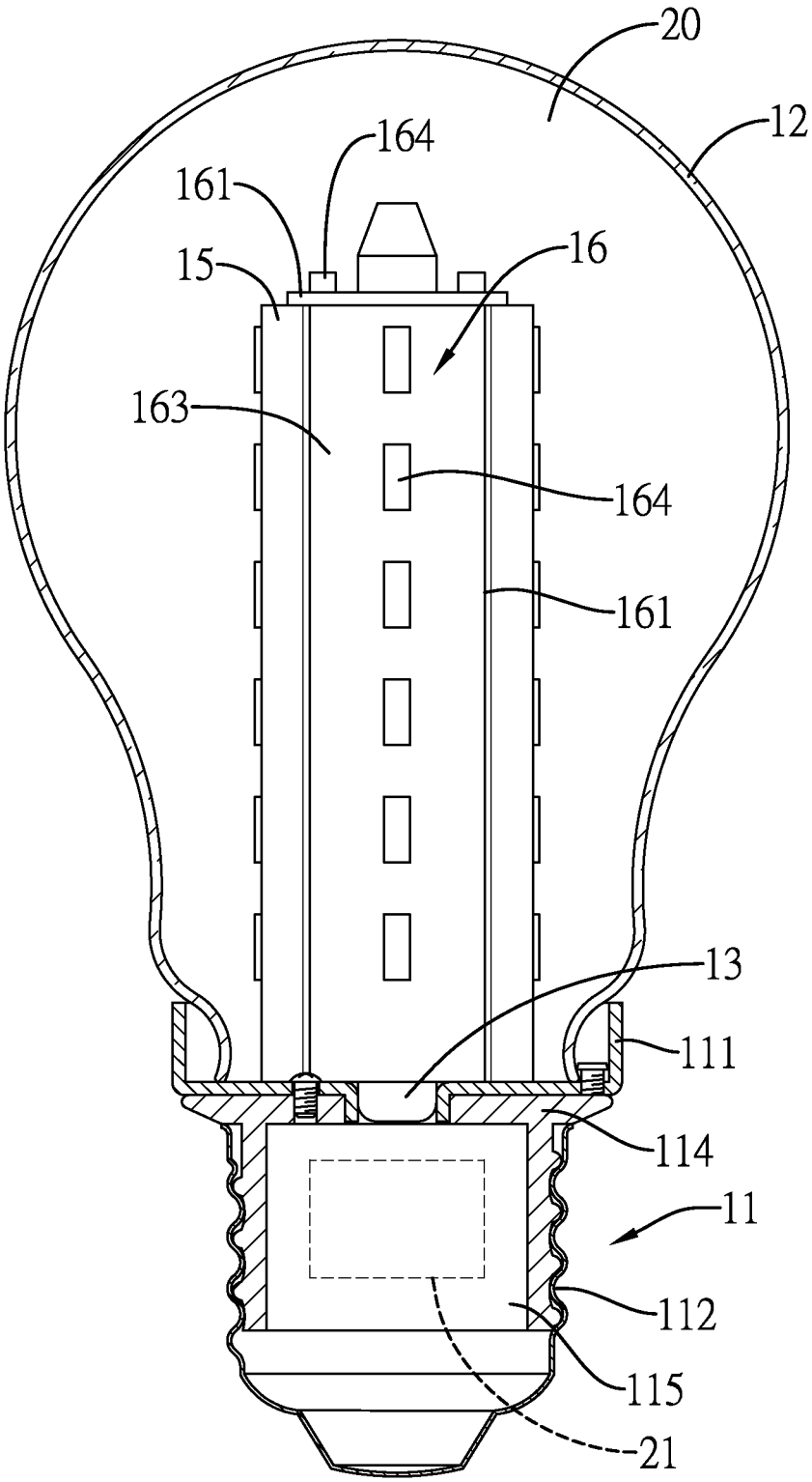
FIG. 8 is a cross-sectional view of a third embodiment of the omnidirectional LED bulb of the invention.

With reference to FIG. 8 which shows a third embodiment, the LED driving circuit is installed and operated in a circuit board 21. The circuit board 21 is mounted in a space 115 within the insulating body 114. The electrical connector 112 will electrically connect the circuit board 21 and the LED module 16.

Figure 9:
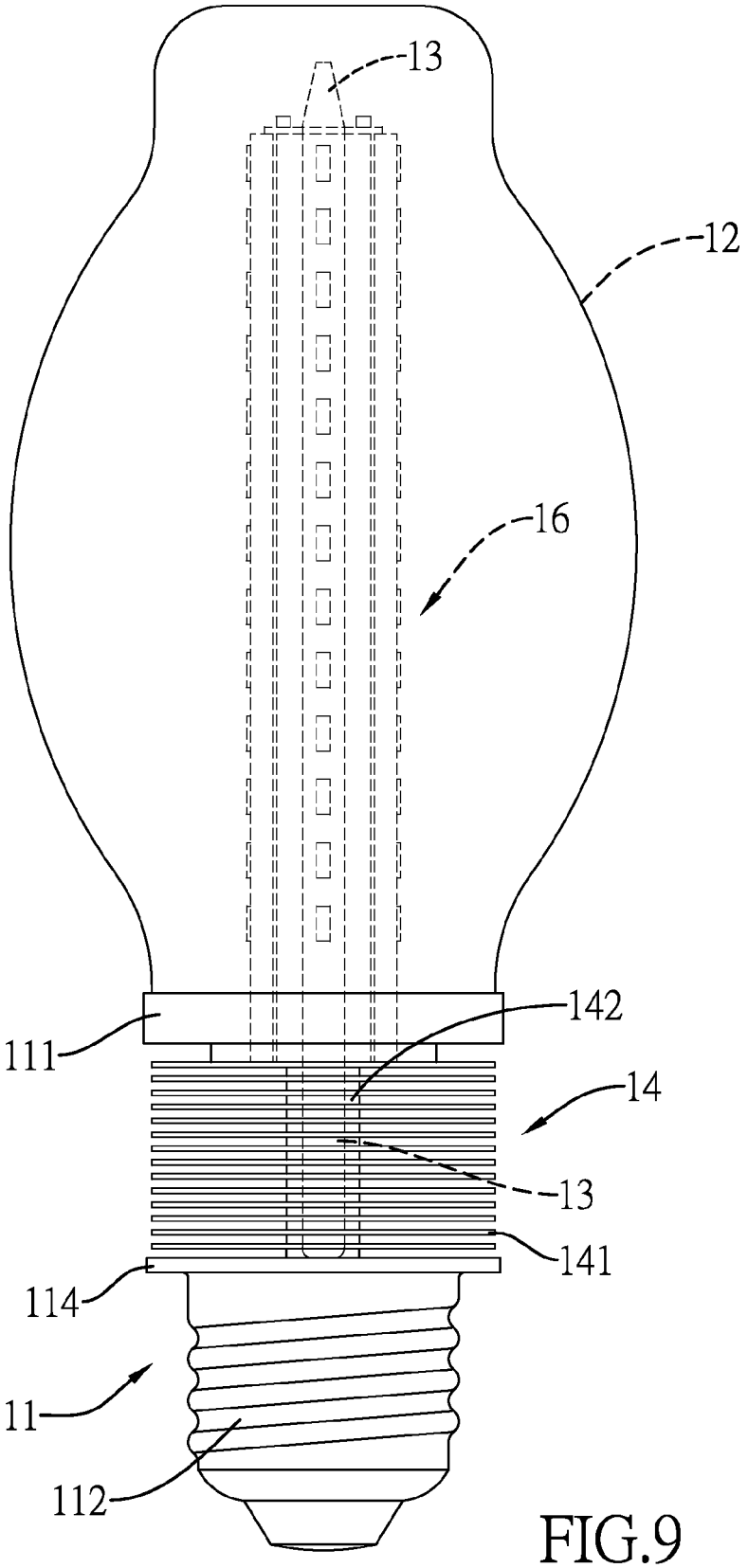
FIG. 9 is a cross-sectional view of a fourth embodiment of the omnidirectional LED bulb of the invention.

With reference to FIG. 9 which shows a fourth embodiment of an omnidirectional LED bulb which further comprises a heat sink 14. The heat sink 14 comprises a plurality of cooling fins 141. The insulating body 114 is mounted between the heat-dissipating connector 111 and the electrical connector 112. The cooling fins 141 are disposed on an external surface of the heat pipe 13 that protrudes from the light-transmitting shell 12. The cooling fins 141 are mounted between the heat-dissipating connector 111 and the insulating body 114. In this fourth embodiment, each cooling fin 141 is mounted around an annular ring 142. The heat pipe 13 is mounted through and attached to the annular rings 142 of the cooling fins 141. For securing the heat sink 14, each cooling fin 141, the heat-dissipating connector 111 and the insulating body 114 can have coincide through holes. Bolts or other fixing device can be mounted through the through holes of the cooling fins 141, the heat-dissipating connector 111 and the insulating body 113. The cooling fin 141 can be aluminum fin, copper fin, plastic fin or ceramic fin. Because the heat sink 14 is attached to the heat pipe 13, the heat produced during the illumination of the LEDs within the shell 12 shall be conducted by the heat pipe 13 and transferred to the cooling fins 141 of the heat sink 14. The heat generated by the LED bulb shall be radiated via the cooling fins 141 of the heat sink 14.

Figure 10:
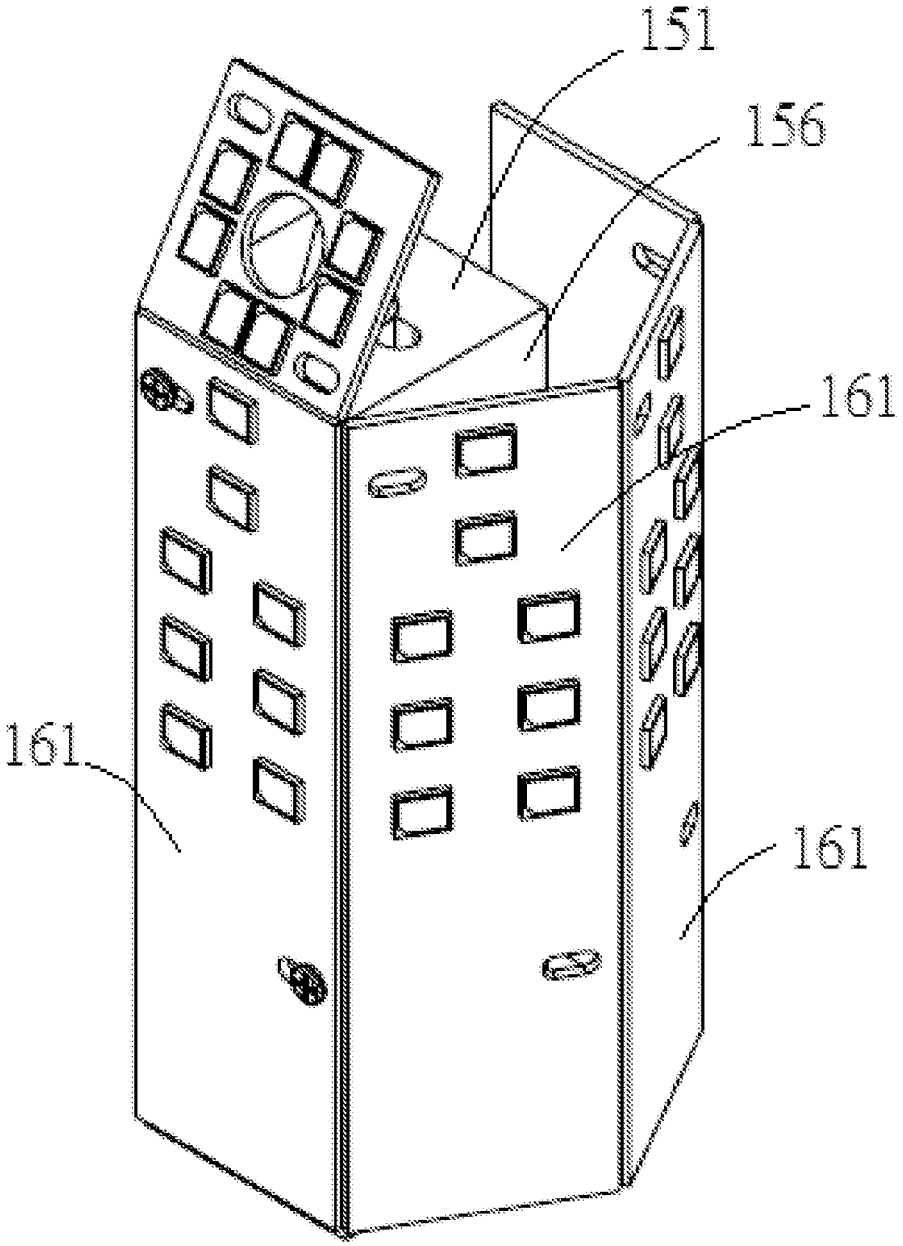
FIG. 10 is a schematic illustration of the heat-dissipating pillar and the LED module of a fifth embodiment of the omnidirectional LED bulb of the invention.
Figure 11:
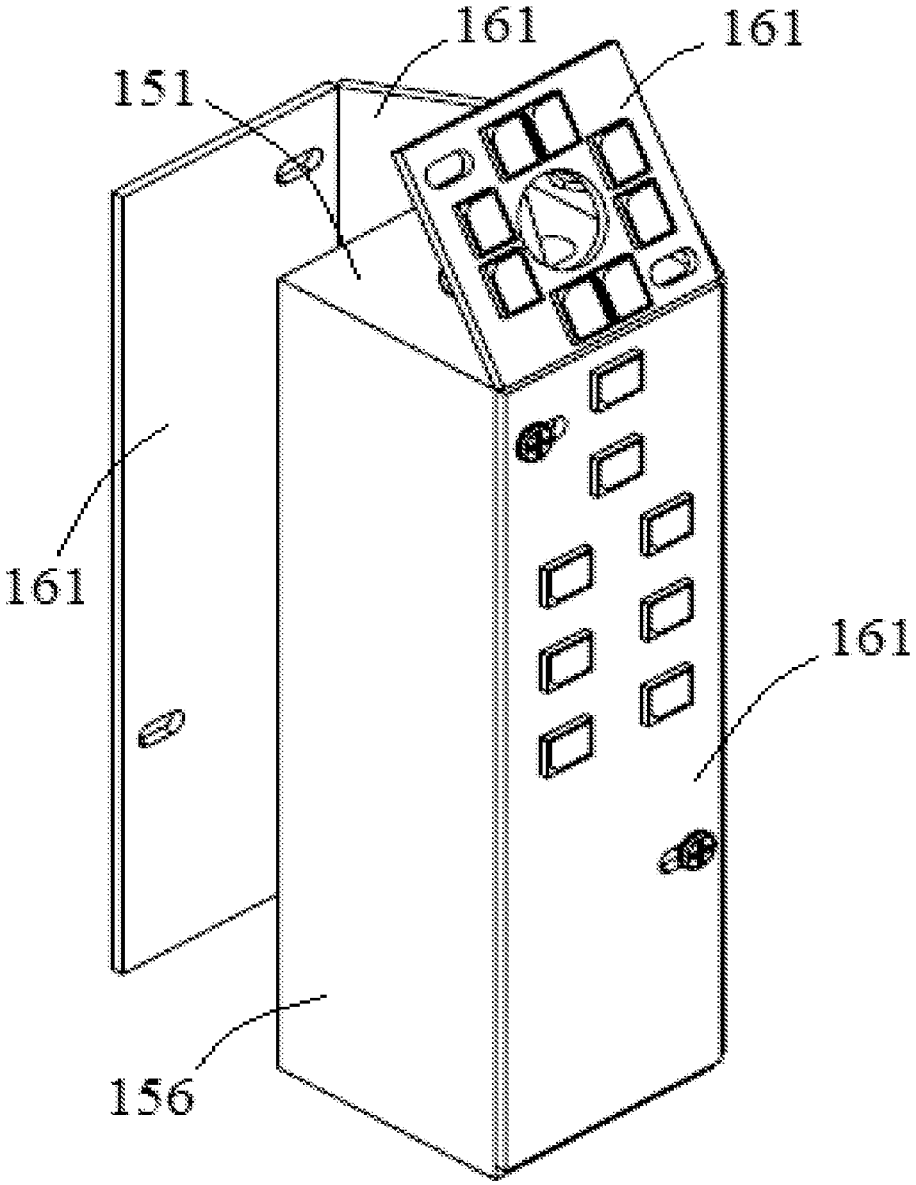
FIG. 11 is a schematic illustration of the heat-dissipating pillar and the LED module for the fifth embodiment of the omnidirectional LED bulb of invention viewed from a different angle.
Figure 12:
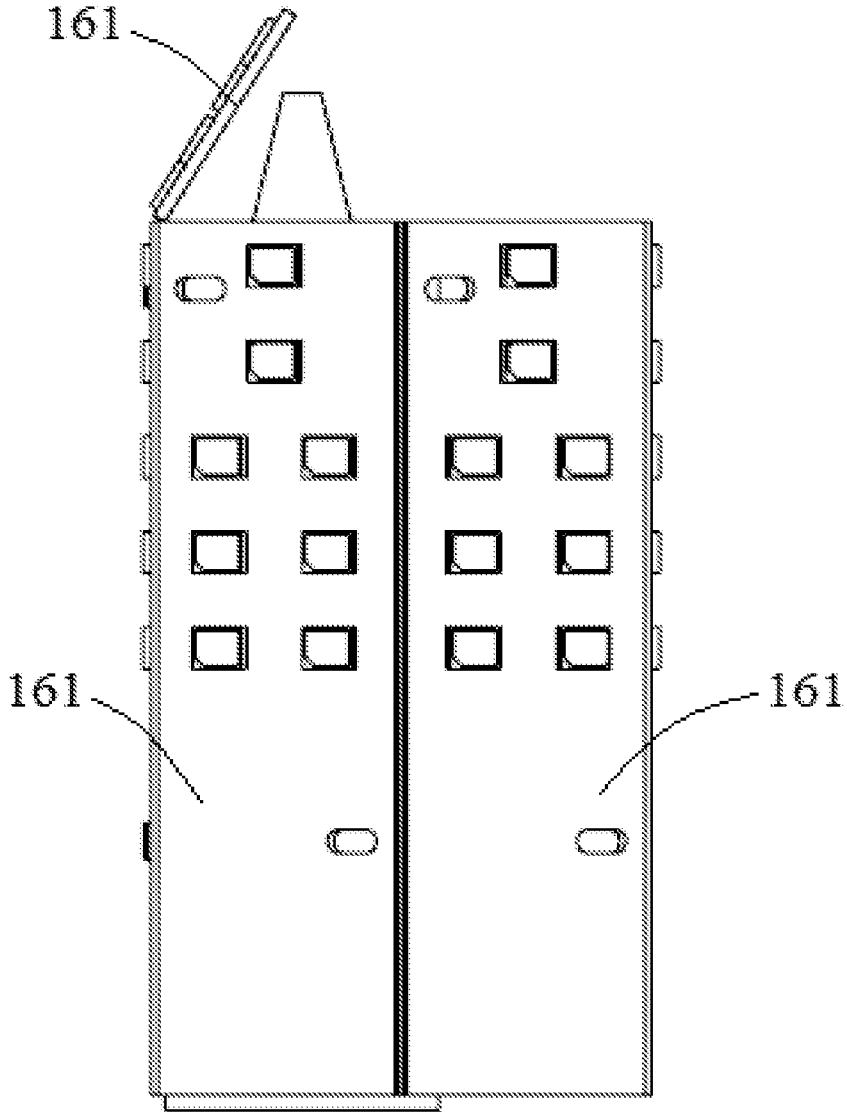
FIG. 12 is a schematic side elevation view of the heat-dissipating pillar and the LED module for the fifth embodiment of the omnidirectional LED bulb of the invention.

Referring to FIGS. 10 to 12 which shows a fifth embodiment of the omnidirectional LED bulb in which the overall structure is substantially the same as the first embodiment shown in FIGS. 4 to 7. The only difference resides on the structure of the heat-dissipating pillar 15 which does not have the engagement groove 152. The four respective lateral surfaces 156 of the heat-dissipating pillar 15 are flat surface. The LED module 16 has five substrates 161 among which four substrates are positioned on the four respective flat surfaces 156 by a certain securing devices. The rest fifth substrate 161 is positioned on the top surface of the heat-dissipating pillar 15 by a securing device. It is readily understood that the illumination operation of the omnidirectional LED bulb according to this fifth embodiment is the same as the previous described embodiment.

In an actual application of the omnidirectional LED bulb according to the invention, the bulb will be installed in an electric socket on a ceiling. The electrical connecter 112 of the base 11 shall be inserted into the socket and the top surface 121 of the light-transmitting shell 12 faces toward the ground. The LED devices 164 will receive the working voltage from the socket for illumination. Because the LED devices 164 emits light through the lateral surface 120 and the top surface 121 of the light-transmitting shell 12, the light from the LED devices 164 will not be blocked. As a result, the omnidirectional LED bulb of the invention can produce a uniform illumination.

Regarding the heat dissipating efficiency, in the second embodiment and the third embodiment, the heat-dissipating pillar 15 will absorb heat generated by the LED devices 164. The heat is transferred from the heat-dissipating pillar 15 to the heat pipe 13 and the base 11. When the heat pipe 13 is heated up, the temperature of the cooling liquid 132 rises correspondingly. The cooling liquid 132 rapidly flows through the pores and undergoes phase changes. According to the above feature, the heat pipe 13 has high heat-dissipating efficiency. The thermal conductivity of the heat pipe 13 is at least ten times greater than that of aluminum. Later, the base 11 radiates heat away from the LED bulb. Based on a circulating phenomenon of the phase change between the aqueous phase and the gas phase of the cooling liquid 132, the LED bulb of the invention has good heat dissipating efficiency.

In the fourth embodiment illustrated in FIG. 9, the heat is further dissipated by the heat sink 14. The cooling fins 141 of the heat sink 14 further absorb heat from the heat pipe 13 and dissipate the heat away from the LED bulb.

While the invention has been described in terms of preferred embodiments, those skilled in the art will recognize that the invention can be practiced with modifications within the spirit and scope of the appended claims.

What is claimed is:

1. An omnidirectional LED bulb comprising:

a base including a heat-dissipating connector and an electrical connector;

a light-transmitting shell mounted on the base and including a plurality of lateral surface and a top surface forming a chamber within the light-transmitting shell and the base;

a heat-dissipating pillar mounted on the heat-dissipating connector in the chamber and including a plurality of mounting surfaces facing both the lateral surface and the top surface of the light-transmitting shell, and a plurality of engagement grooves;

an LED module mounted on the mounting surfaces of the heat-dissipating pillar and including a plurality of substrates each mounted in each engagement groove and having a front surface and a rear surface;

an LED driving circuit integrated in the substrates of the LED module; and at least one LED device mounted on the front surface of the LED module.

* * * * *